United States Patent [19]

Foster

[11] Patent Number: 4,826,016

[45] Date of Patent: May 2, 1989

[54] SUBDIVIDABLE CARTON FOR CONTAINERIZED PRODUCTS

[75] Inventor: David N. Foster, Westwood, Mass.

[73] Assignee: The Gillette Co., Boston, Mass.

[21] Appl. No.: 184,990

[22] Filed: Apr. 22, 1988

[51] Int. Cl.[4] ..... B65D 5/54

[52] U.S. Cl. ..... 206/602; 229/120.03; 229/120.37; 229/120.38

[58] Field of Search ..... 206/602, 623, 627; 229/120.03, 120.23, 120.35, 120.37, 120.38, 120.18, DIG. 11, 905, 906

[56] References Cited

U.S. PATENT DOCUMENTS

| | | | |
|---|---|---|---|
| 2,012,132 | 8/1935 | Koppelman et al. | 229/120.03 |
| 2,287,729 | 6/1942 | Fallert | 206/602 |
| 2,448,795 | 9/1948 | Grecco | 206/602 |
| 2,591,629 | 4/1952 | Spalding | 229/120.03 |
| 2,710,130 | 6/1955 | Grecco | 206/602 |
| 2,737,334 | 3/1956 | Halgren | 206/602 |
| 3,048,318 | 8/1962 | Sabin | 229/120.38 |
| 3,082,929 | 3/1963 | Aquino et al. | 229/120.18 |
| 3,101,880 | 8/1963 | Peterson | 206/602 |
| 3,226,010 | 12/1965 | Rogers, Jr. | 229/87 |
| 3,392,904 | 7/1968 | Wei | 229/33 |
| 3,412,920 | 11/1968 | Desforges | 229/15 |
| 3,921,893 | 11/1975 | Randle, Jr. | 229/120.03 |
| 4,194,678 | 3/1980 | Jasper | 229/23 R |
| 4,417,686 | 11/1983 | Wozaiacki | 229/52 B |
| 4,467,923 | 8/1984 | Dornbusch | 206/602 |

FOREIGN PATENT DOCUMENTS

| | | | |
|---|---|---|---|
| 2446231 | 9/1980 | France | 229/DIG. 11 |
| 909873 | 11/1962 | United Kingdom | 229/DIG. 11 |

*Primary Examiner*—Stephen Marcus
*Assistant Examiner*—Gary E. Elkins
*Attorney, Agent, or Firm*—Scott R. Foster

[57] ABSTRACT

The present disclosure is directed to the combination of a primary box having closed side and end walls, a bottom and a hinged top with a pair of chamfered U-shaped inserts having the bases of the U-shape in unattached abutting relationship with the outside legs of the U-shape glued to the inside walls of the box with a cutting line marked on the outside of the box adjacent to the unattached abutting bases of the U-shaped inserts for cutting the box into two separately transportable secondary boxes of product containers and for selling and transporting less than all the containers of the primary box.

5 Claims, 3 Drawing Sheets

SUBDIVIDABLE CARTON FOR CONTAINERIZED PRODUCTS

TECHNICAL FIELD

My invention is directed to corrugated cartons of the subdividable type for initially transporting, for example, twelve containers from a supplier to a wholesaler in a single carton, who may cut the container in half to ship two—six packs to different distributors for subsequent shipment to retailers without impairment to the transportable integrity of the six pack container and its contents resulting in loss of one or more of the containers.

BACKGROUND ART

Heretofore, many forms of cartons have been devised to transport a plurality of containers, for example, plastic containers of shampoo from a supplier to a wholesaler, where the initial carton can be cut into smaller units to supply retail outlets ordering less than the number of units supplied by the producer. It is known in the art to provide a shipping container, separable into two containers if the U-shaped members were merely 3-sided. However such a container has a disadvantage in that if the person making the cut allows the knife to go a bit off line, a wall of one of the containers may be cut at the same time. This problem is overcome with the chamfered construction of the present invention as shown, allowing the cutting step to be performed quickly, without harm if the knife is allowed to go a bit off line.

The closest art known to me prior to this application are the following U.S. patents issued to the following inventors:

- D. S. PETERSON, U.S. Pat. No. 3,101,880, Aug. 27, 1963
- F. ROGERS, JR., U.S. Pat. No. 3,226,010, Dec. 28, 1965
- C. C. WEI, U.S. Pat. No. 3,392,904, July 16, 1968
- J. X. DESFORGES, U.S. Pat. No. 3,412,920, Nov. 26, 1968
- M. F. JASPER, U.S. Pat. No. 4,194,678, Mar. 25, 1980
- R. M. WOZAIACKI, U.S. Pat. No. 4,417,686, Nov. 29, 1983
- A. H. DORNBUSCH, et al, U.S. Pat. No. 4,467, 923, Aug. 28, 1984

DISCLOSURE OF THE INVENTION

In accordance with my invention, I provide a corrugated box primary container for receiving and transporting twelve product containers which somewhere along the supply line may be reduced to two containers of six product containers each without impairing the transporting integrity of the smaller transporter container.

An object of my invention is to provide a carton with two U-shaped opposed dividers placed in a primary container with the backs of their closed bottoms in unattached abutting relationship with the outsides of the legs of the U-shape glued to the inside walls of the primary container. The juncture between the base or bottom of the U and the legs or sides thereof are chamfered to define therebetween a cutting zone along a cut line marked circumferentially about the primary container. This is to avoid cutting damage to the individual product containers. These U-shaped chamfered dividers also provide stacking strength to the containers as well as defining end walls to the container cartons when separated into two six packs.

A standard shipping carton for bottled products, such as toiletries products, is designed to hold 12 containers which is probably the most cost-effective size. However, wholesale distributors, frequently resell the products to retailers who prefer to buy in multiples of 6. For this reason the practice has evolved of including within the 12-unit carton two separately wrapped "6-packs."

This practice of using two complete carriers or 6-packs within an outer larger carton is expensive, and consequently it has been proposed to provide a shipping carton which can be cut into two separate smaller cartons by inserting into the carton a pair of U-shaped corrugated linerboard pieces, aligned back-to-back, so to speak, with the side portions of the U-shaped members securely glued to the inside walls of the carton, but with the abutting base portions of the U-shaped members not glued. A circumferential cut line is provided so that when the carton is cut into two portions, the base portions of the U-shaped members provide suitable end walls for the two resulting cartons.

BEST MODE FOR CARRYING OUT THE INVENTION

Figure 1:
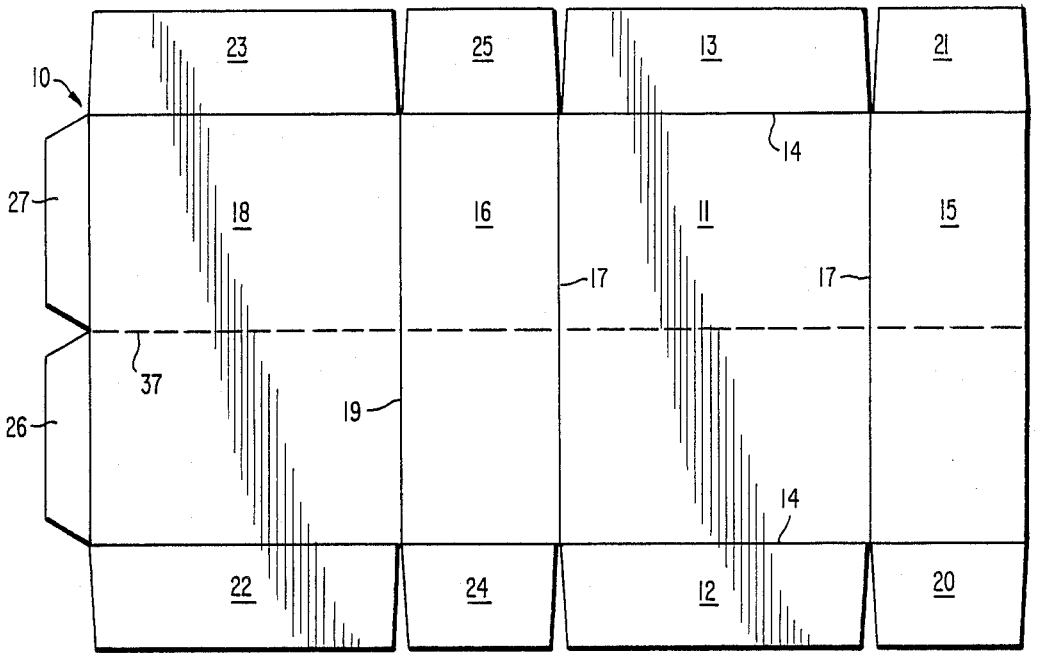
FIG. 1 is a plan view of blank of the carton of the present invention.
Figure 2:
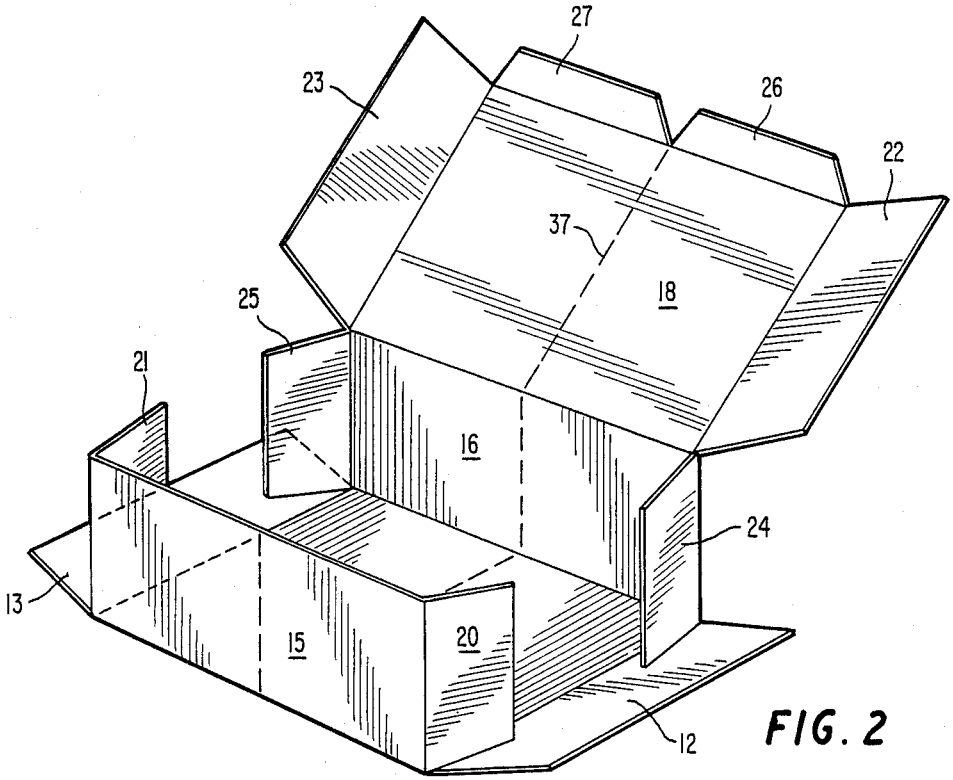
FIG. 2 is perspective view of the subdividable carton for small containers partially assembled.
Figure 4:
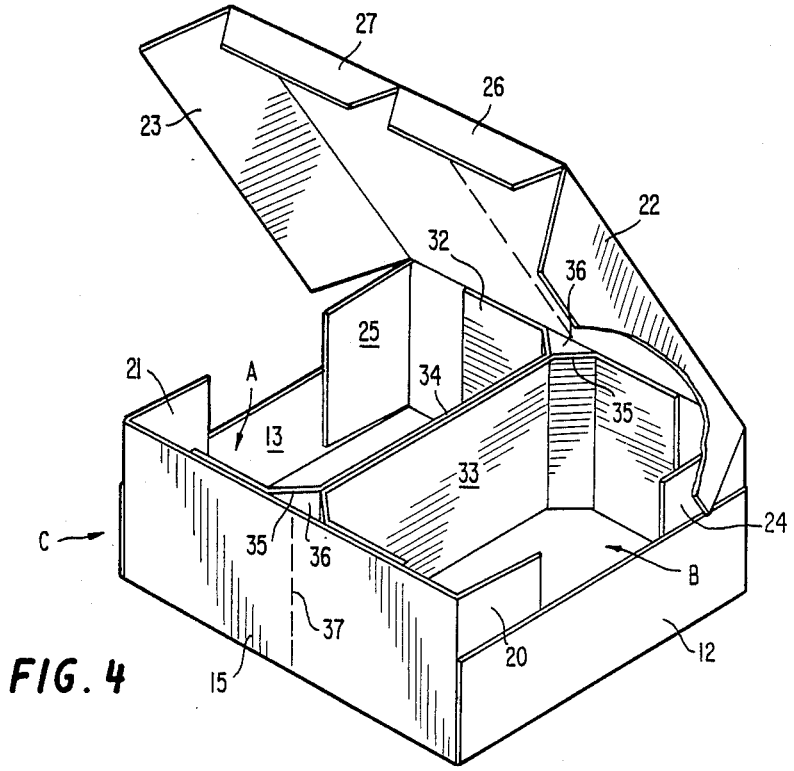
FIG. 4 is a perspective view of the carton of FIG. 3 with insert separators in position.

Referring now to the drawings and for the moment to FIGS. 1 and 4, 10 designates a single blank of suitable fluted stock, such, for example, as pasteboard, paperboard, corrugated paper board or the like. The blank is cut and scored to provide box forming parts for large or small containers which comprises a bottom panel 11 and lower end panels 12 and 13, which extend from opposite ends of the bottom panel 11 and are foldably joined thereto by fold line determining scores 14. Side panels 15 and 16, extend from opposite sides of the bottom panel 11 and are foldably joined thereto by fold line determining scores 17. The top 18, extends off side panel 16 to which it is foldably joined by fold line determining scores 19. Side panel 15 has end flaps 20 and 21 which are glued to lower end panels 12 and 13.

The top 18 has end flaps 22 and 23 which are glued to end flaps 20,21,24 and 25, foldably joined to side panels 15 and 16. Short flaps 26 and 27 are glued to the outside of side panel 15 when all containers 28, to be transported are in place as shown in FIG. 6.

Figure 3:
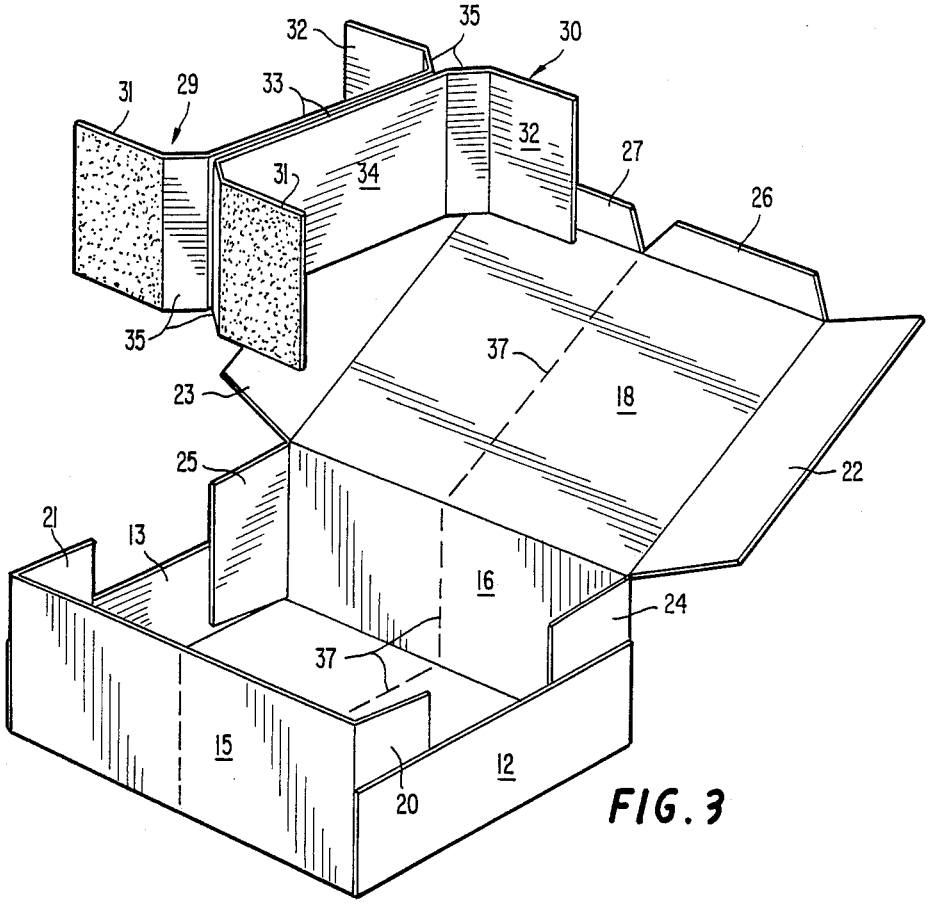
FIG. 3 is an exploded perspective view of the carton of the present invention showing the carton and inserts for small containers.
Figure 5:
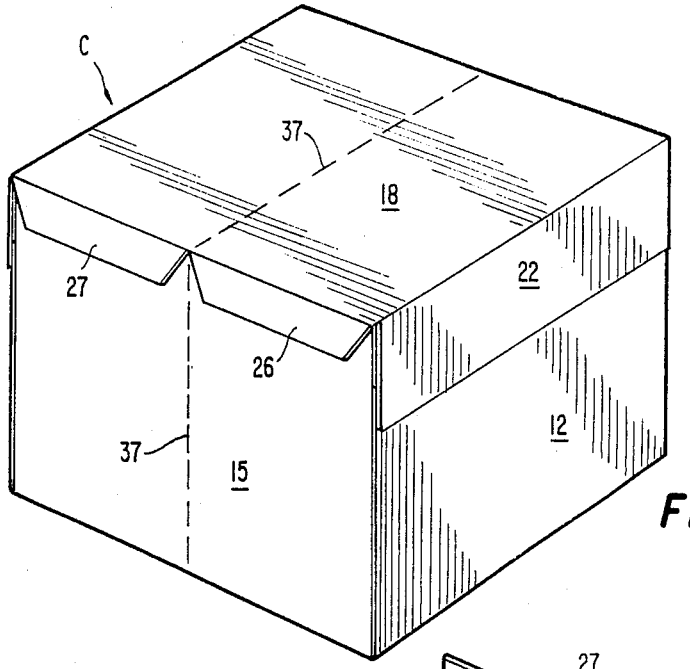
FIG. 5 is a perspective view of a closed twelve pack container, according to the present invention for large containers.
Figure 6:
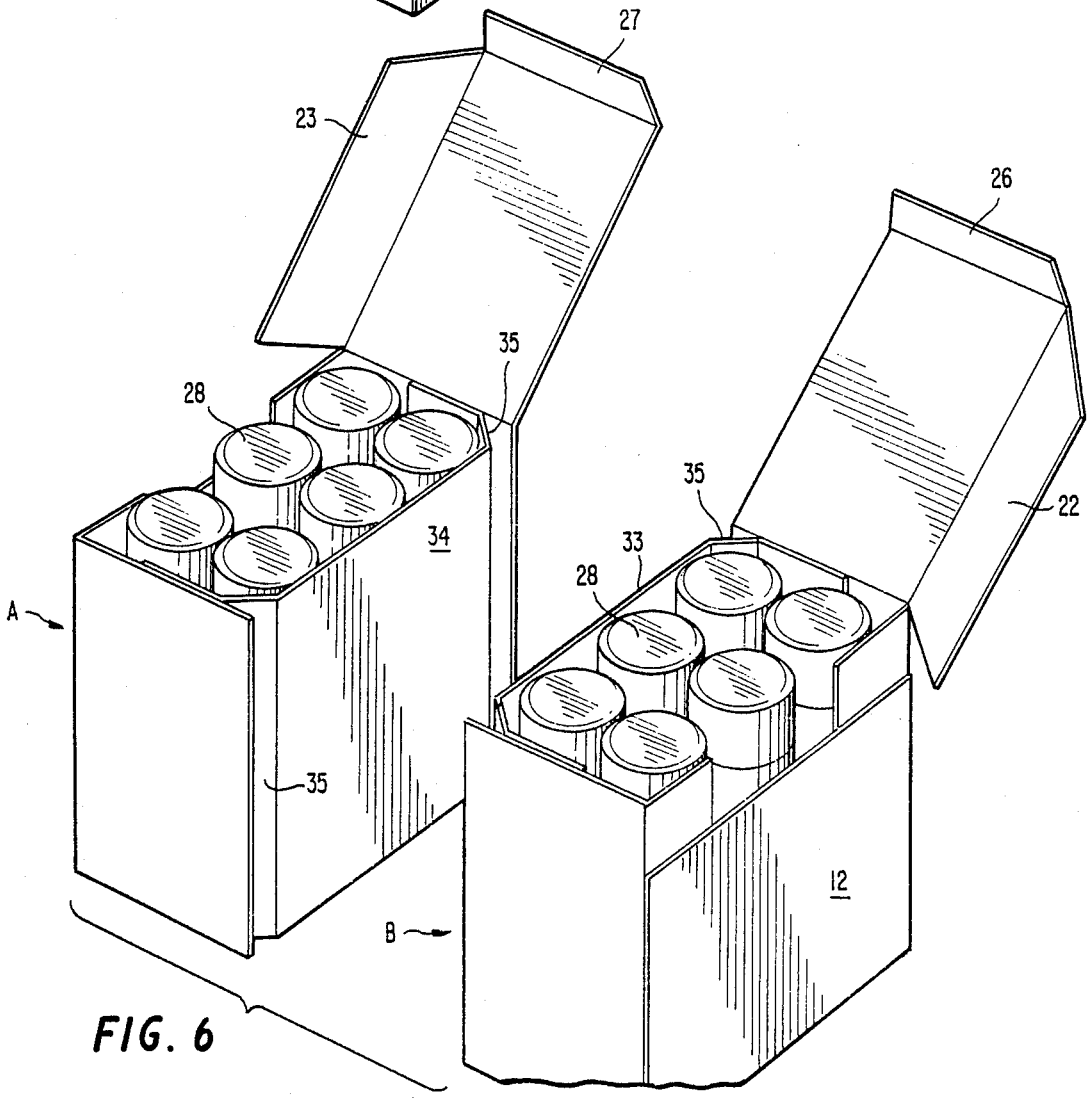
FIG. 6 is a perspective view of the subdivided carton of FIG. 5, for large containers having been divided.

As best seen in FIGS. 3 and 4 the interior of the carton C is subdividable into two sub-containers A and B for small plastic containers, for example, of hair spray or shampoo, while FIGS. 5 and 6 illustrate a carton for taller products. A pair of U-shaped dividers 29 and 30 of fluted box construction being of corrugated liner board having legs 31 and 32, which are glued to the inside walls of the side panels 15 and 16 and the unattached abutting walls 33 and 34 form the bottom of the U-shape. The juncture of the abutting walls 33 and 34 and their legs 31 and 32, see FIGS. 3 and 4, are chamfered at 35 to define a container protective cutting zone 36 behind a cut line 37, printed on the side walls 15 and 16 as well as on tip 18 and bottom 11.

When it is desired to subdivide the carton C into, for example, two six-pack containers, A and B each containing 6 plastic bottles of hair spray, it is cut by knife along the cut line 37. The two opposed unattached ends 33 and 34 of the U-shaped end walls 29 and 30 will retain the bottles 28 in each severed six-pack.

The inserts 29 and 30 while defining side walls for the two six-pack containers A and B, also substantially adds to the stacking strength of a whole 12 container carton.

What I claim is:

1. In combination a closed retangular shipping carton for a plurality of product containers having top, bottom side and end walls to permit breaking the containers down into at least two closed smaller package units to product containers, a pair of opposed U-shaped dividers having their legs and closed bases placed with the closed base of each U-shape in unattached abutting relationship, and the outside of said legs being glued to the side walls of said rectangular shipping container, said U-shaped dividers being chamfered at a juncture of the base of their U-shape to the legs of the U-shape dividers defining a cutting zone, and a cut line on and about the outside of the shipping carton positioned to overlie the chamfered portions of said abutting dividers within the cutting zone so that the shipping carton may be externally incised along the cut line to subdivide the shipping carton into two independent shipping cartons of a lesser number of containers without injury to the product containers without impairing the transportable integrity of the two subdivided shipping cartons.

2. In combination a closed rectangular shipping carton for a plurality of product containers having top, bottom, side and end walls to permit cutting the container down into at least two closed smaller package units of product containers, a pair of opposed U-shaped dividers within the carton with bottom of said U-shape dividers in unattached abutting relationship, and the outside portion of legs of said U-shaped dividers being glued to the inside walls of said rectangular shipping carton, said U-shaped dividers being chamfered at a juncture of the base of their U-shape and the legs of their U-shape dividers to define a cutting zone, and a cut line peripherally about the outside of the shipping carton positioned to over lie the chamfered portions of said abutting dividers on the outside of said shipping carton within the cutting zone so that the shipping carton may be externally incised along the cut line to subdivide the shipping carton into two independent shipping cartons of a lesser number of containers without impairing the transportable integrity of the two subdivided cartons.

3. In combination a rectangular box for transporting a plurality of container units comprising a carton having opposed spaced apart long side walls connected to short spaced apart end walls, a bottom and a rectangular top, and a short flap extending from each short side of said rectangular top wall, a pair of U-shaped inserts of substantially the same vertical height as the depth of the box, said inserts having bases and side walls and being chamfered intermediate said bases and side walls and positioned in said box with their bases opposed and in non attaching contact, the outside long side walls of said box, the area defined between the chamfered portions of each abutting insert defining a cut zone, and a cut line about the external wall on the top, bottom and side walls of the box within the cut zone so that the carton may be cut into two separate container carrying boxes without impairing the transport integrity of the two subdivided shipping cartons or injuring the individual containers to be transported in the subdivided shipping cartons.

4. The combination of claim 3 further comprising end flaps extending from the short sides of the rectangular top glued to the the outside carton walls.

5. In combination, a closed four sided box of fluted box material having a hinged top for transporting a plurality of product containers, a pair of opposed U-shaped chamfered inserts of fluted box material substantially the same vertical height as the depth of the box, said inserts having bases and side walls and positioned with their bases opposed in said box and in non attaching contact and the outside surfaces of the legs of said U-shaped inserts being glued to opposed side walls of said box, the area defined by the two chamfers of each insert defining a cut zone about the external wall of top, bottom and side walls of the box so that the box can be cut into two separate container carrying boxes without impairing the transport integrity of the two subdivided shipping cartons or injuring the individual containers to be transported in the subdivided shipping cartons.

* * * * *